US008398100B2

(12) United States Patent
Tedla

(10) Patent No.: US 8,398,100 B2
(45) Date of Patent: Mar. 19, 2013

(54) SKATEBOARD APPARATUS

(76) Inventor: Hailu Teferi Tedla, Campbell, CA (US)

( * ) Notice: Subject to any disclaimer, the term of this patent is extended or adjusted under 35 U.S.C. 154(b) by 0 days.

(21) Appl. No.: 13/309,562

(22) Filed: Dec. 2, 2011

(65) Prior Publication Data

US 2012/0139203 A1 Jun. 7, 2012

Related U.S. Application Data

(60) Provisional application No. 61/458,959, filed on Dec. 3, 2010.

(51) Int. Cl.
*A63C 17/01* (2006.01)

(52) U.S. Cl. ..... 280/87.042; 280/11.27

(58) Field of Classification Search ..... 280/11.27, 280/11.28, 87.042, 87.041
See application file for complete search history.

(56) References Cited

U.S. PATENT DOCUMENTS 3,197,227 A * 7/1965 Anselmo ..... 280/87.01
4,084,831 A * 4/1978 Akonteh et al. ..... 280/11.215
5,127,672 A * 7/1992 Horibata ..... 280/842
5,263,725 A * 11/1993 Gesmer et al. ..... 280/11.28
5,860,861 A * 1/1999 Lipps et al. ..... 463/36
6,065,763 A * 5/2000 Adams, Jr. ..... 280/11.28
6,079,724 A * 6/2000 Lin ..... 280/221
6,848,527 B2 * 2/2005 Nelson ..... 180/181
7,053,288 B2 * 5/2006 Iwai et al. ..... 84/600
7,073,805 B2 * 7/2006 Yan ..... 280/221
7,581,739 B2 * 9/2009 Fraley ..... 280/87.041
2002/0043778 A1 * 4/2002 Huang ..... 280/87.042
2004/0195795 A1 * 10/2004 Huang ..... 280/87.042
2005/0269794 A1 * 12/2005 Lukes ..... 280/87.042
2006/0006622 A1 * 1/2006 Gesmer et al. ..... 280/87.042
2007/0273118 A1 * 11/2007 Conrad ..... 280/87.042
2009/0227426 A1 * 9/2009 Dubar ..... 482/34
2012/0264579 A1 * 10/2012 Klein et al. ..... 482/146

* cited by examiner

*Primary Examiner* — J. Allen Shriver, II
*Assistant Examiner* — Andrew Khouzam
(74) *Attorney, Agent, or Firm* — Ash Tankha; Lipton, Weinberger & Husick

(57) ABSTRACT

A skateboard apparatus comprising a truck assembly is provided. The truck assembly comprises a suspension assembly, a pivot element, a collapsible tubular member, a compression spring, and a tension spring. The suspension assembly comprises a suspension spring for creating a rocking motion about a longitudinal axis of the board structure. The collapsible tubular member is threadedly connected to the pivot element, which is pivotally connected to the suspension assembly. The compression spring is externally and coaxially mounted around sleeve members of the collapsible tubular member. The tension spring coaxially that extends through the collapsible tubular member, in communication with the compression spring, telescopically extends and retracts the collapsible tubular member for creating an upward motion and a downward motion respectively, of the board structure. The suspension assembly synchronizes the upward and downward motion with the rocking motion of the board structure for creating a surf-like motion on a ground surface.

20 Claims, 10 Drawing Sheets

SKATEBOARD APPARATUS

CROSS REFERENCE TO RELATED APPLICATIONS

This application claims the benefit of provisional patent application No. 61/458,959 titled "Skate-surfing board", filed on Dec. 3, 2010 in the United States Patent and Trademark Office.

The specification of the above referenced patent application is incorporated herein by reference in its entirety.

BACKGROUND

Skateboard and surfing communities are closely inter-related as a large percentage of skateboarders are surfers and vice versa. However, due to environmental conditions, for example, water conditions, temperature conditions, other weather conditions, etc., or lack of access to a suitable water surface, a rider of a skateboard may desire a surf-like experience while skateboarding on a ground surface.

Moreover, typical surfing activities involve a considerable amount of risk as they involve exposing a rider to unpredictable forces of nature, for example, high or unmanageable waves. Surfing activities are also restricted to persons of a particular age group with sufficient stamina and strong physical abilities, and to persons that reside in the vicinity of coastal geographical locations. Persons who do not have access to coastal geographical locations may often feel the need to experience surfing motion without having to visit a beach.

A typical skateboard is designed to be used on a ground surface without producing any wave-like movements, which precludes a rider from experiencing a surf-like ride while performing a skating activity. Moreover, a typical skateboard is not constructed to create a suitable rocking motion synchronized with a suitable upward motion and a downward motion on a ground surface to provide the rider with a surf-like experience on the ground surface. Furthermore, riders of skateboards generally ride on specially constructed ramps, which are expensive and not always available, in an effort to avoid touching the ground surface in order to gain momentum.

Hence, there is a long felt but unresolved need for a skateboard apparatus that provides a user with a surf-like experience by creating a surf-like motion on a ground surface. Furthermore, there is a need for a skateboard apparatus that combines the appeal of surfing, conventional skateboarding on a continuous ramp, and jumping off the ground surface without having to touch the ground surface repeatedly.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The skateboard apparatus disclosed herein addresses the above mentioned need for providing a user with a surf-like experience by creating a surf-like motion on a ground surface. The skateboard apparatus disclosed herein combines the appeal of surfing, skateboarding on a continuous ramp, and jumping off the ground surface without having to touch the ground surface repeatedly. The skateboard apparatus disclosed herein simulates a surf-like motion on the ground surface and also simulates motion of a skateboard on a continuous ramp.

The skateboard apparatus disclosed herein comprises a truck assembly positioned between a first truck member and a second truck member for supporting a board structure. The truck assembly comprises a suspension assembly, a pivot element, a collapsible tubular member, a compression spring, and a tension spring. The suspension assembly is positioned through the board structure, for example, through the mid-section of the board structure. The suspension assembly comprises a suspension spring disposed within a housing. The housing bulges above an upper surface of the board structure. In an embodiment, the skateboard apparatus disclosed herein further comprises a gripping mat, for example, made of rubber, mounted on the upper surface of the board structure for preventing slippage of the user standing on the upper surface of the board structure.

The pivot element is pivotally connected to the suspension assembly for enabling the suspension spring of the suspension assembly to create a rocking motion along a length of the board structure about a longitudinal axis of the board structure. In an embodiment, the skateboard apparatus disclosed herein further comprises a pre-load fastening assembly comprising a bolt and a nut. The bolt of the pre-load fastening assembly connects the suspension assembly to the pivot element. A spring rate of the suspension spring of the suspension assembly is adjusted by tightening the nut on the bolt of the pre-load fastening assembly. As used herein, the term "spring rate" refers to the amount of weight needed to compress the suspension spring a certain distance. The pivot element limits the direction of the rocking motion along the length of the board structure.

In an embodiment, the collapsible tubular member comprises two or more sleeve members coaxially and slidably connected to each other for enabling extension and retraction of the collapsible tubular member. An upper sleeve member of the collapsible tubular member is threadedly connected to the pivot element and a lower sleeve member of the collapsible tubular member is mounted on a third truck member. Each of the first truck member, the second truck member, and the third truck member comprises an axle with wheels for propelling the board structure. In an embodiment, the suspension assembly is configured based on height of the extension of the collapsible tubular member and length of the board structure.

The compression spring is externally and coaxially mounted around the collapsible tubular member. The compression spring alternately expands and compresses, thereby moving the sleeve members of the collapsible tubular member alternately inward and outward and creating, for example, an upward motion and downward motion. The tension spring is coaxially positioned within the collapsible tubular member and coaxially extends through the collapsible tubular member. In an embodiment, the skateboard apparatus further comprises a connecting element for adjustably affixing the tension spring to the third truck member. The tension spring, in communication with the compression spring, telescopically extends and retracts the telescoping collapsible tubular member for creating the upward motion and the downward motion respectively, of the board structure. The connecting element statistically loads the compression spring to oppose the tension spring, thereby loading the tension spring to a maximum limit of elasticity to produce a time release force to extend the collapsible tubular member over a period of time.

The suspension assembly synchronizes the upward motion and the downward motion of the board structure with the rocking motion of the board structure for creating a surf-like motion of the board structure on the ground surface. The skateboard apparatus disclosed herein propels forward via the first truck member, the second truck member, and the third truck member, on receiving weight of a user standing on the upper surface of the board structure, and creates the surf-like motion on the ground surface by synchronization of the upward motion and the downward motion with the rocking motion of the board structure.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION OF THE INVENTION

Figure 1:
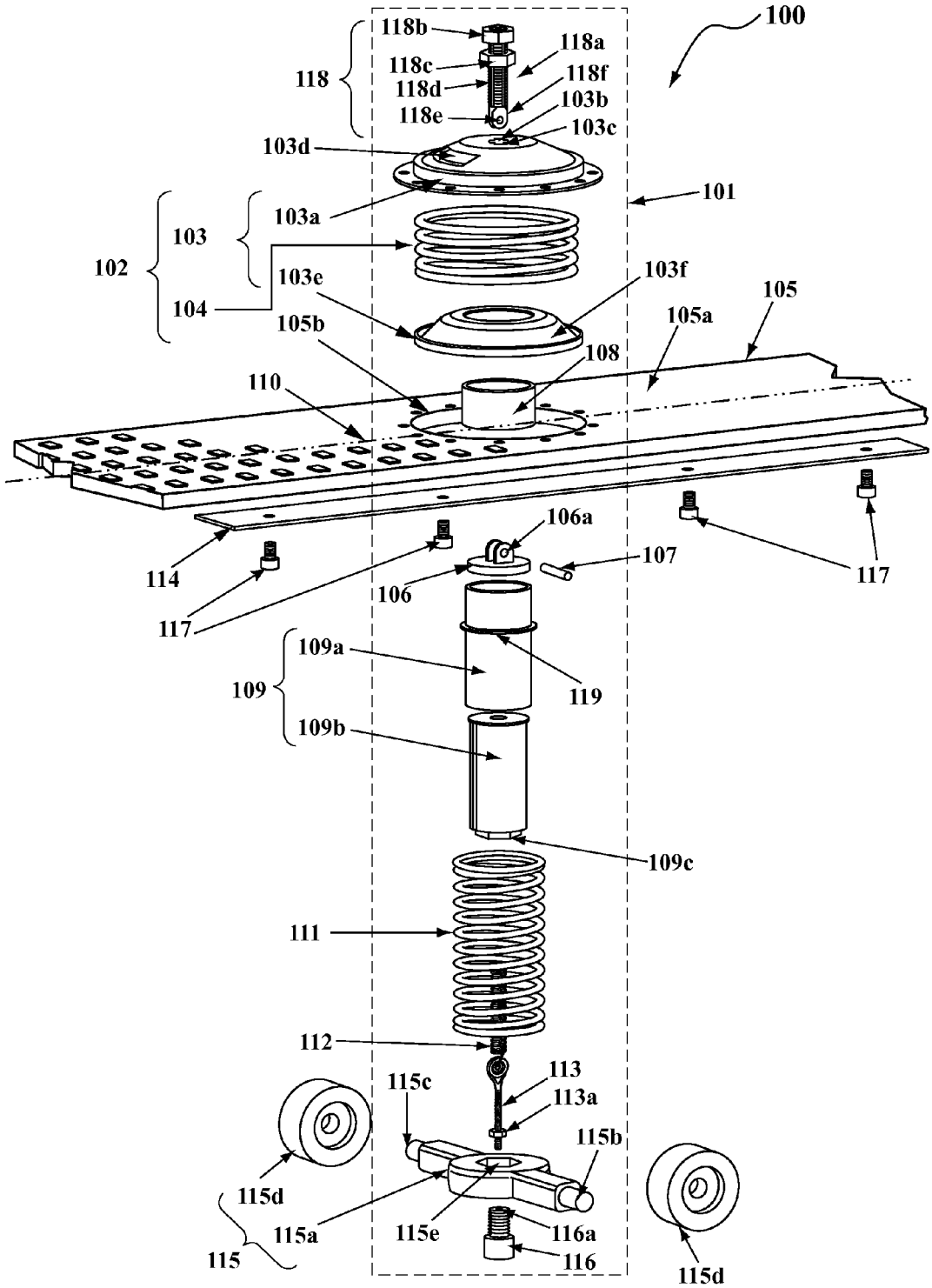
FIG. 1 exemplarily illustrates an exploded perspective view of a skateboard apparatus that creates a surf-like motion on a ground surface.

FIG. 1 exemplarily illustrates an exploded perspective view of a skateboard apparatus 100 that creates a surf-like motion on a ground surface. The skateboard apparatus 100 disclosed herein comprises a truck assembly 101 positioned between a first truck member 120 and a second truck member 121 for supporting a board structure 105 as exemplarily illustrated in FIG. 2. As used herein, the term "truck member" refers to a support member positioned on a bottom surface 105*c* of the board structure 105, that mounts and supports wheels 115*d*, 120*b*, or 121*b* of the skateboard apparatus 100. Reinforcement ribs 114 are attached to the bottom surface 105*c* of the board structure 105, for example, using bolts 117, as exemplarily illustrated in FIG. 4, for strengthening the board structure 105. The truck members 115, 120, and 121 are used for steering the board structure 105 on which a user stands. As used herein, the term "user" refers to a person, for example, a surfer, a skateboarder, etc., who rides the skateboard apparatus 100. The truck members 115, 120, and 121 are made, for example, from aluminum. As exemplarily illustrated in FIG. 1, the truck assembly 101 further comprises a third truck member 115. The third truck member 115 comprises an axle 115*a* that supports wheels 115*d* on opposing sides 115*b* and 115*c* of the axle 115*a*. The truck members 115, 120, and 121 are configured in different sizes depending upon the size of the board structure 105.

The truck assembly 101 comprises a suspension assembly 102, a pivot element 106, a collapsible tubular member 109, a compression spring 111, and a tension spring 112. The suspension assembly 102 comprises a suspension spring 104 disposed within a housing 103. The housing 103 comprises a cap 103*a* and a seat 103*e*. The seat 103*e* of the housing 103 comprises a protrusion 103*f* that accommodates the suspension spring 104. The cap 103*a* and the seat 103*e* of the housing 103 hold the suspension spring 104 in place. The suspension assembly 102 is configured based on the height of extension of the collapsible tubular member 109 and length of the board structure 105. The board structure 105 is equipped with a suspension spring pre-load fastening assembly 118. The pre-load fastening assembly 118 comprises a bolt 118*a* and a hexagonal jam nut 118*b*. The bolt 118*a* connects the suspension assembly 102 to the pivot element 106. The bolt 118*a* is configured to pass through an opening 103*b* in the cap 103*a* of the housing 103 and connects to the pivot element 106 via a pivot pin 107 inserted through the opening 106*a*.

In an embodiment, axial grooves 118*d* are cut along the length of the bolt 118*a*, and tongues 103*c* are cut along the circumference of the opening 103*b* in the cap 103*a* of the housing 103 for receiving the grooves 118*d* of the bolt 118*a*. The bolt 118*a* of the pre-load fastening assembly 118 comprises an opening 118*e* at the lower end 118*f* of the bolt 118*a*. When the opening 118*e* at the lower end 118*f* of the bolt 118*a* aligns with the opening 106*a* of the pivot element 106, the pivot pin 107 is inserted through the openings 118*e* and 106*a* for connecting the suspension assembly 102 to the pivot element 106. The spring rate of the suspension spring 104 of the suspension assembly 102 can be adjusted by tightening the hexagonal jam nut 118*b* of the pre-load fastening assembly 118 and by fastening the hexagonal nut 118*c* via a slot 103*d* defined on the cap 103*a* of the housing 103. As used herein, the term "spring rate" refers the amount of weight needed to compress the suspension spring 104 a certain distance. The spring rate of the suspension spring 104 is adjusted by the pre-load fastening assembly 118 for any force, load, terrain or athletic ability required by the user, by rotating the hexagonal jam nut 118*b* on the bolt 118*a*.

The pivot element 106 is pivotally connected to the suspension assembly 102 through the pivot pin 107. The pivot pin 107 allows pivotal motion of the board structure 105 on a longitudinal axis 110 along the length of the board structure 105. The pivot pin 107 is configured based on the entire load applied on the pivot pin 107. The pivot pin 107 is produced, for example, by a casting process. The collapsible tubular member 109 is mounted on the third truck member 115. As exemplarily illustrated in FIG. 1, the collapsible tubular member 109 comprises, for example, an upper sleeve member 109*a* and a lower sleeve member 109*b*. During skating of the skateboard apparatus 100, the lower sleeve member 109*b* reciprocates within the upper sleeve member 109*a* of the collapsible tubular member 109. The lower sleeve member 109*b* of the collapsible tubular member 109 has, for example, a hexagonal cross section at its lower end 109*c* and is mounted on to a drilled hexagonal counter bore 115*e* of the axle 115*a* of the third truck member 115 and secured in place, for example, by a cup screw 116. The upper sleeve member 109*a* of the collapsible tubular member 109 comprises a shoulder ring 119 configured for retaining the seat 103*e* of the housing 103 against the upper sleeve member 109*a* of the collapsible tubular member 109. A bushing 108 is configured from a suitable material for providing a spring type press fit between the collapsible tubular member 109 and the seat 103*e* of the housing 103.

The compression spring 111 is configured to coaxially surround the collapsible tubular member 109. The compression spring 111 is, for example, a coil spring that resists an axially applied compressive force. The compression spring 111 is configured to compress and become smaller when a compressive load is applied on the compression spring 111. The compressive load is, for example, the weight of a user standing on the board structure 105. When compressed, the compression spring 111 stores the energy as potential energy which is released when the compression spring 111 is relaxed.

The tension spring 112 is configured to coaxially extend through the collapsible tubular member 109. The tension spring 112 also referred to as an extension spring, comprises helically wound coils, wrapped tightly together to create tension. For purposes of illustration, the detailed description refers to a coil tension spring; however the scope of the skateboard apparatus 100 disclosed herein is not limited to a coil tension spring but may be extended to include other configurations and devices that create opposing forces, for example, fluid, air, rubber, a bungee cord, etc. The tension spring 112 has a hook, a loop, or an end coil that is formed from each end of its body. The tension spring 112 provides a counter force when the compression spring 111 is released, thereby enforcing an extended release of the potential energy of the compression spring 111. The tension spring 112 is adjustably affixed to the third truck member 115, for example, by a threaded connecting element 113. The connecting element 113 is connected through an opening 116*a* that passes through the cup screw 116. The compression spring 111 and the tension spring 112 are adjusted to reach an approximately exact balance, for example, by rotating a nut 113*a* positioned on the connecting element 113 from underneath the third truck member 115, thereby maintaining stability of the skateboard apparatus 100. The connecting element 113 statistically loads the compression spring 111 to oppose the tension spring 112, thereby loading the tension spring 112 to a maximum limit of elasticity to produce a time release force to extend the collapsible tubular member 109 over a period of time.

Figure 2:
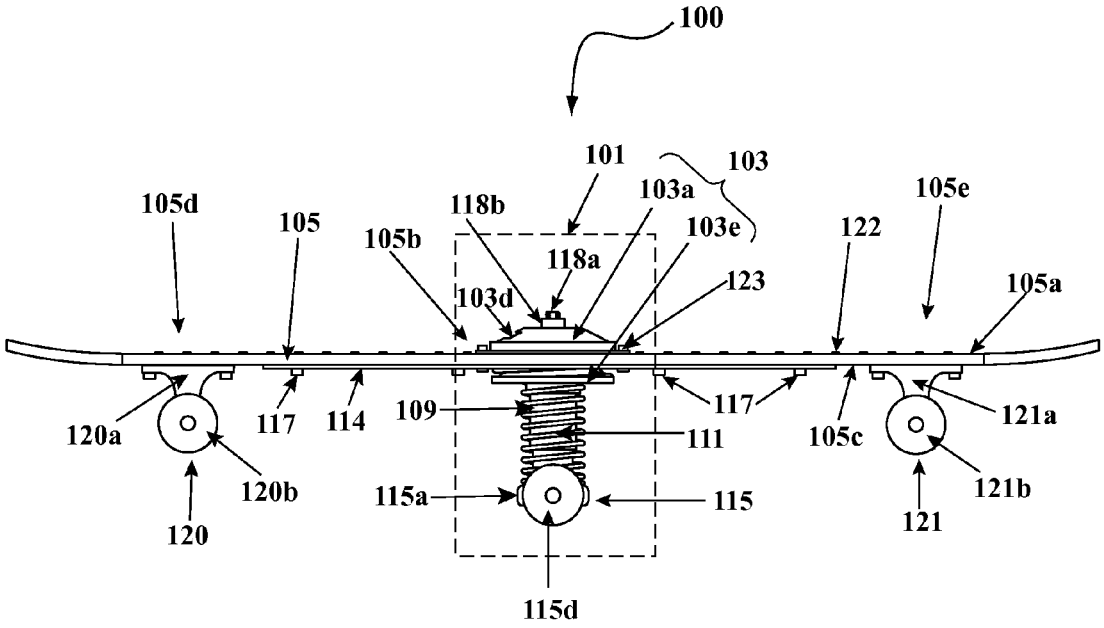
FIG. 2 exemplarily illustrates a side assembled view of the skateboard apparatus.

FIG. 2 exemplarily illustrates a side assembled view of the skateboard apparatus 100. The truck assembly 101 of the skateboard apparatus 100 is positioned between a first truck member 120 and a second truck member 121 for supporting the board structure 105. Each of the first truck member 120, the second truck member 121, and the third truck member 115 comprises an axle 120*a*, 121*a*, 115*a* with wheels 120*b*, 121*b*, 115*d* respectively, for propelling the board structure 105. The wheels 120*b*, 121*b*, 115*d* of the first truck member 120, the second truck member 121, and the third truck member 115 respectively are, for example, made of polyurethane. The suspension assembly 102 exemplarily illustrated in FIG. 1 of the truck assembly 101 is positioned, for example, through a mid-section 105*b* of the board structure 105 such that the cap 103*a* of the housing 103 rests on and bulges above the upper surface 105*a* of the board structure 105. The seat 103*e* of the housing 103 configured as exemplarily illustrated in FIG. 1 is extended downward to retain the suspension spring 104 of a preconfigured height and diameter without limiting the amplitude of motion of the compression spring 111. The seat 103*e* of the housing 103 is retained in place by the shoulder ring 119 configured on the upper sleeve member 109*a* of the collapsible tubular member 109.

The first truck member 120 and the second truck member 121 are disposed on a front section 105*d* and a rear section 105*e* respectively, of the board structure 105. The load distribution along the longitudinal axis 110 of the board structure 105 exemplarily illustrated in FIG. 1, is less at the front section 105*d* and the rear section 105*e* and increases from the front section 105*d* and the rear section 105*e* towards the mid-section 105*b* of the board structure 105. The reinforcement ribs 114 attached to the bottom surface 105*c* of the board structure 105 account for this uneven distribution of load. The reinforcement ribs 114 are attached to the bottom surface 105*c* of the board structure 105 using the bolts 117 as exemplarily illustrated in FIG. 4. The collapsible tubular member 109 is threadedly connected to the pivot element 106 as exemplarily illustrated in FIG. 6. The compression spring 111 of the truck assembly 101 coaxially surrounds the collapsible tubular member 109.

The housing 103 is configured, dimensioned and adapted to bulge in the mid-section 105*b* of the board structure 105, to house the suspension spring 104 taking into consideration the ergonomically allowable height of the collapsible tubular member 109 for safe operation, and to maximize the height of the compression spring 111 for maximum amplitude, thereby creating an optimum surf-like feel of the ride for a user of the skateboard apparatus 100.

Figure 3:
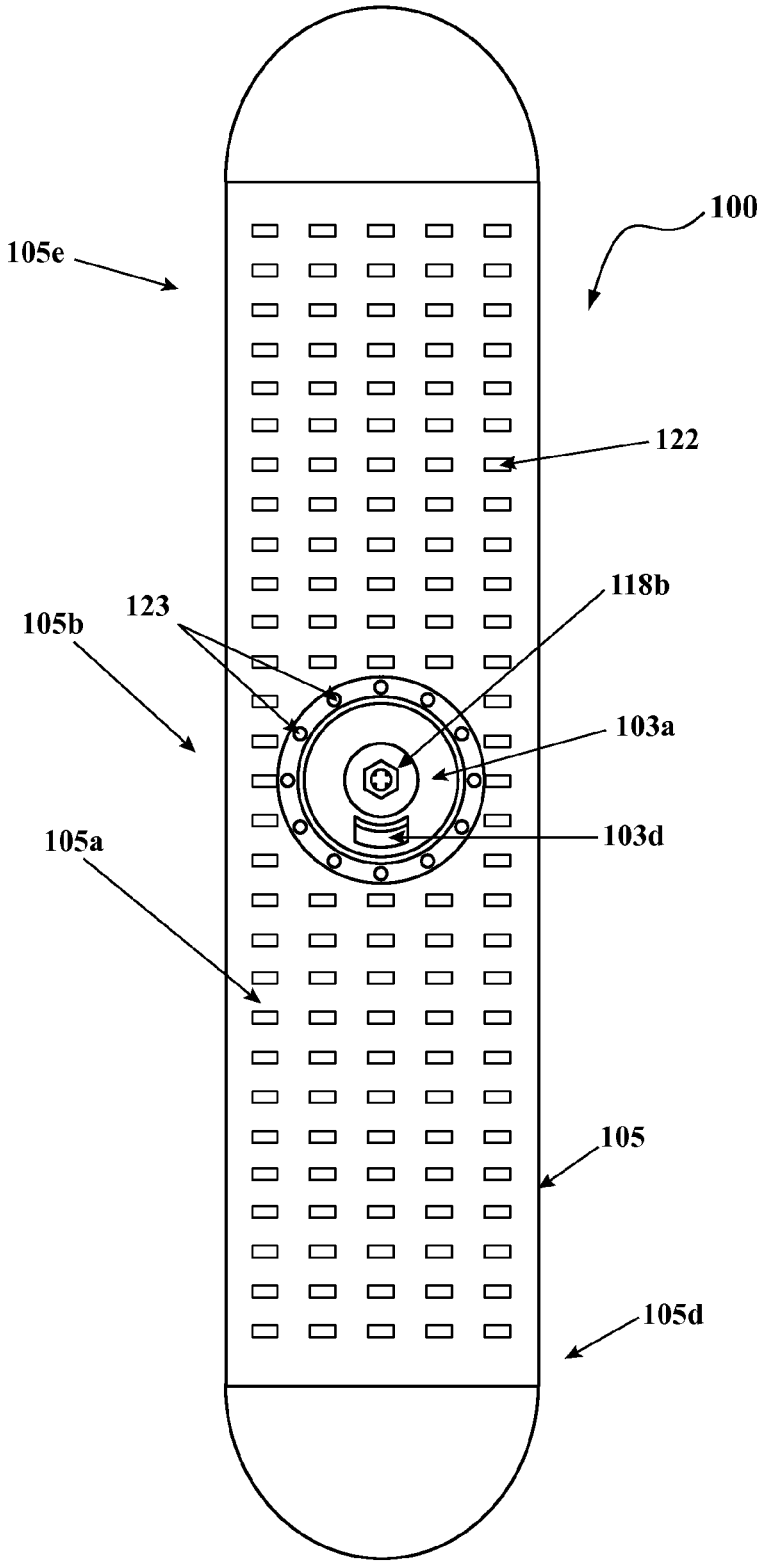
FIG. 3 exemplarily illustrates a top orthographic view of the skateboard apparatus.

FIG. 3 exemplarily illustrates a top orthographic view of the skateboard apparatus 100. The board structure 105 of the skateboard apparatus 100 comprises a curvedly shaped front section 105*d* and a curvedly shaped rear section 105*e*. The board structure 105 is manufactured, for example, from compression molded fiber glass, wood, carbon fiber, aluminum, plastic, etc. In an embodiment, the skateboard apparatus 100 disclosed herein further comprises a gripping mat 122 mounted on the upper surface 105*a* of the board structure 105. The gripping mat 122 prevents slippage of the user standing on the upper surface 105*a* of the board structure 105. The gripping mat 122 has anti-slip properties and is made, for example, from a gripping material such as rubber. In an embodiment, the cap 103*a* of the housing 103 of the suspension assembly 102 exemplarily illustrated in FIG. 1, is manufactured from a suitable material and fastened to the mid-section 105*b* of the board structure 105, for example, by fasteners 123 such as screws.

Figure 4:
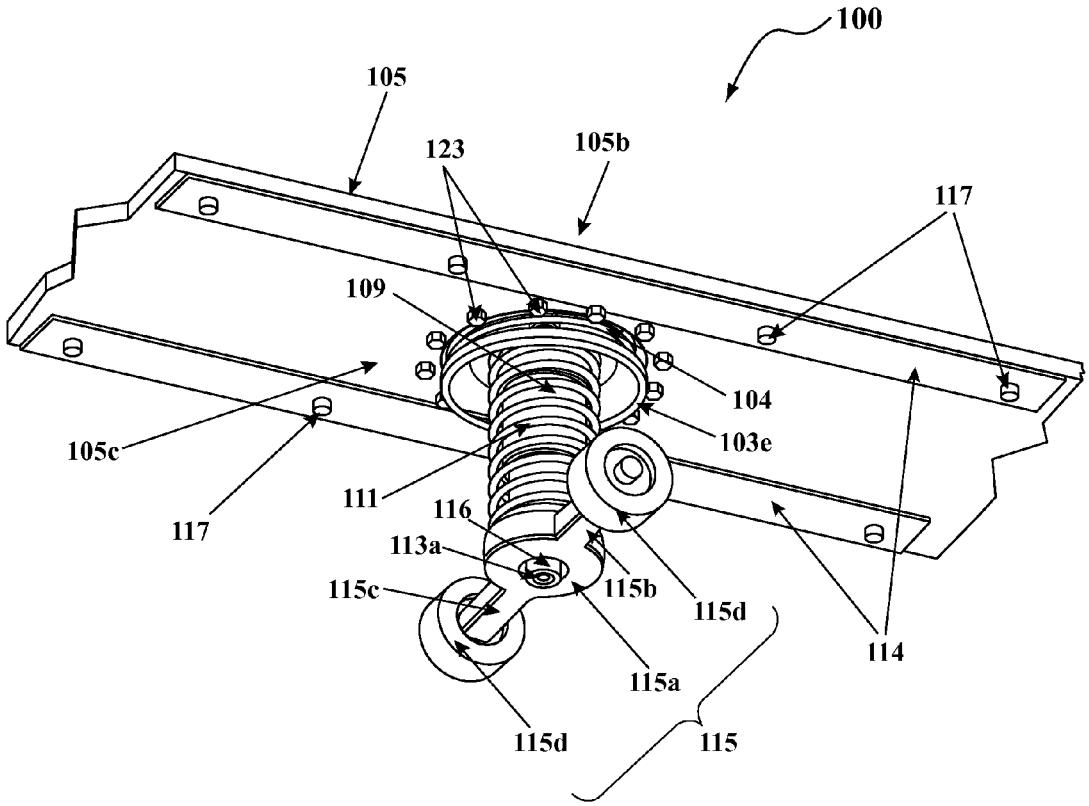
FIG. 4 exemplarily illustrates a partial bottom perspective view of the skateboard apparatus.

FIG. 4 exemplarily illustrates a partial bottom perspective view of the skateboard apparatus 100. This partial bottom perspective view shows the third truck member 115 extending from the bottom surface 105*c* of the board structure 105 via the collapsible tubular member 109. The third truck member 115 comprises the axle 115*a* with wheels 115*d* on opposing sides 115*b* and 115*c* of the axle 115*a* for propelling the board structure 105. The reinforcement ribs 114 attached to the bottom surface 105*c* of the board structure 105 using the bolts 117 compensates for the uneven distribution of load on the skateboard apparatus 100. The compression spring 111 coaxially surrounds the collapsible tubular member 109, and alternately expands and compresses about and along with the collapsible tubular member 109 for creating an upward motion and a downward motion of the board structure 105.

Figure 5:
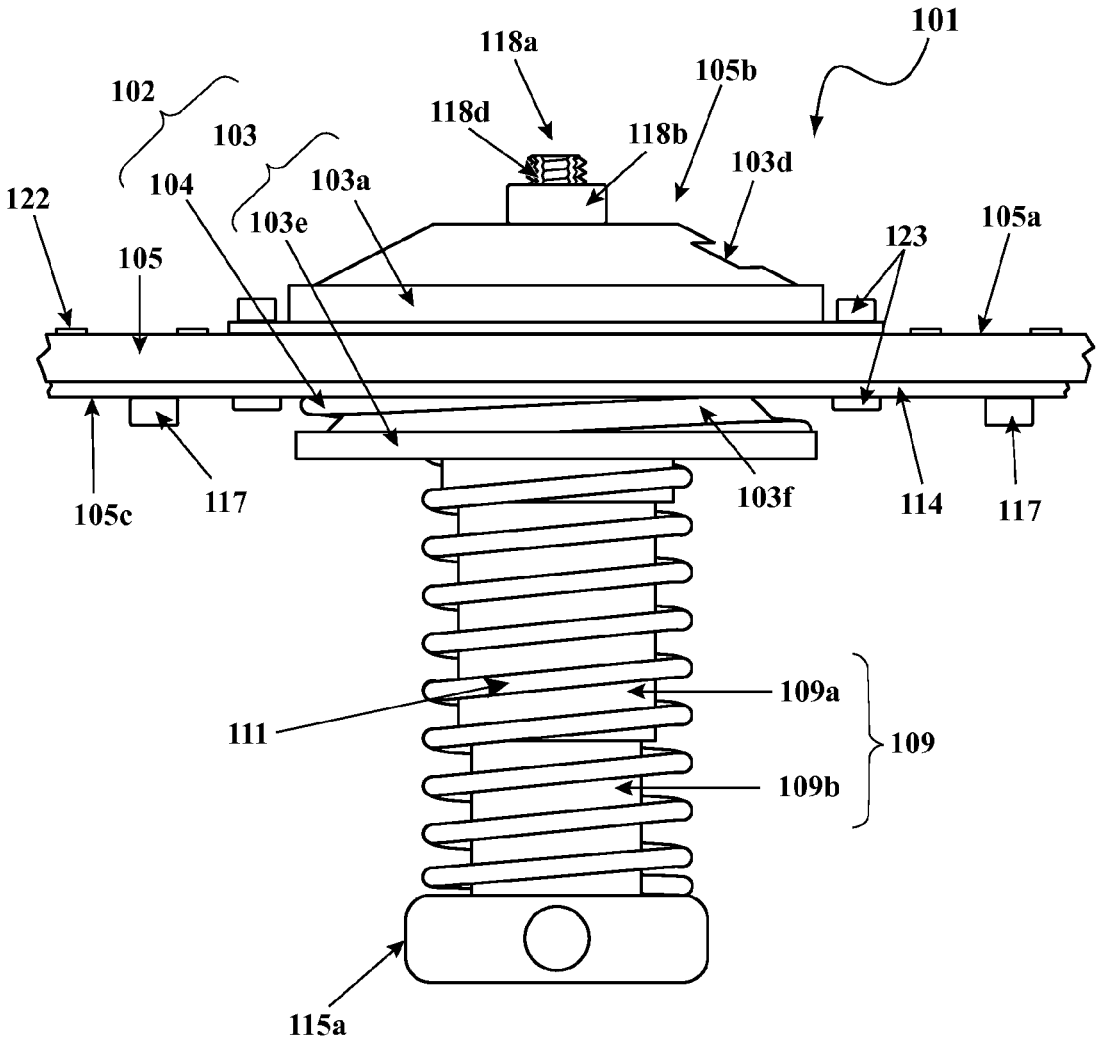
FIG. 5 exemplarily illustrates a partial side orthographic view of the skateboard apparatus.

FIG. 5 exemplarily illustrates a partial side orthographic view of the skateboard apparatus 100. The compression spring 111 of the truck assembly 101 of the skateboard apparatus 100 experiences a compression force by movement of the center of mass of the user. The collapsible tubular member 109 of the truck assembly 101 comprises two or more sleeve members 109*a* and 109*b* coaxially and slidably connected to each other for enabling the extension and retraction of the collapsible tubular member 109. The upper sleeve member 109*a* is coaxially mounted over the lower sleeve member 109*b* and slides over the lower sleeve member 109*b*. The lower sleeve member 109*b* of the spring loaded variable sleeve telescoping collapsible tubular member 109 is mounted on the third truck member 115. The cap 103*a* of the housing 103 that houses the suspension spring 104 of the suspension assembly 102 rests on and protrudes above the upper surface 105*a* of the board structure 105, while the seat 103*e* of the housing 103 extends downwardly and below the bottom surface 105*c* of the board structure 105. The seat 103*e* of the housing 103 is retained in place by the shoulder ring 119 configured on the upper sleeve member 109*a* of the collapsible tubular member 109 as exemplarily illustrated in FIG. 1.

Figure 6:
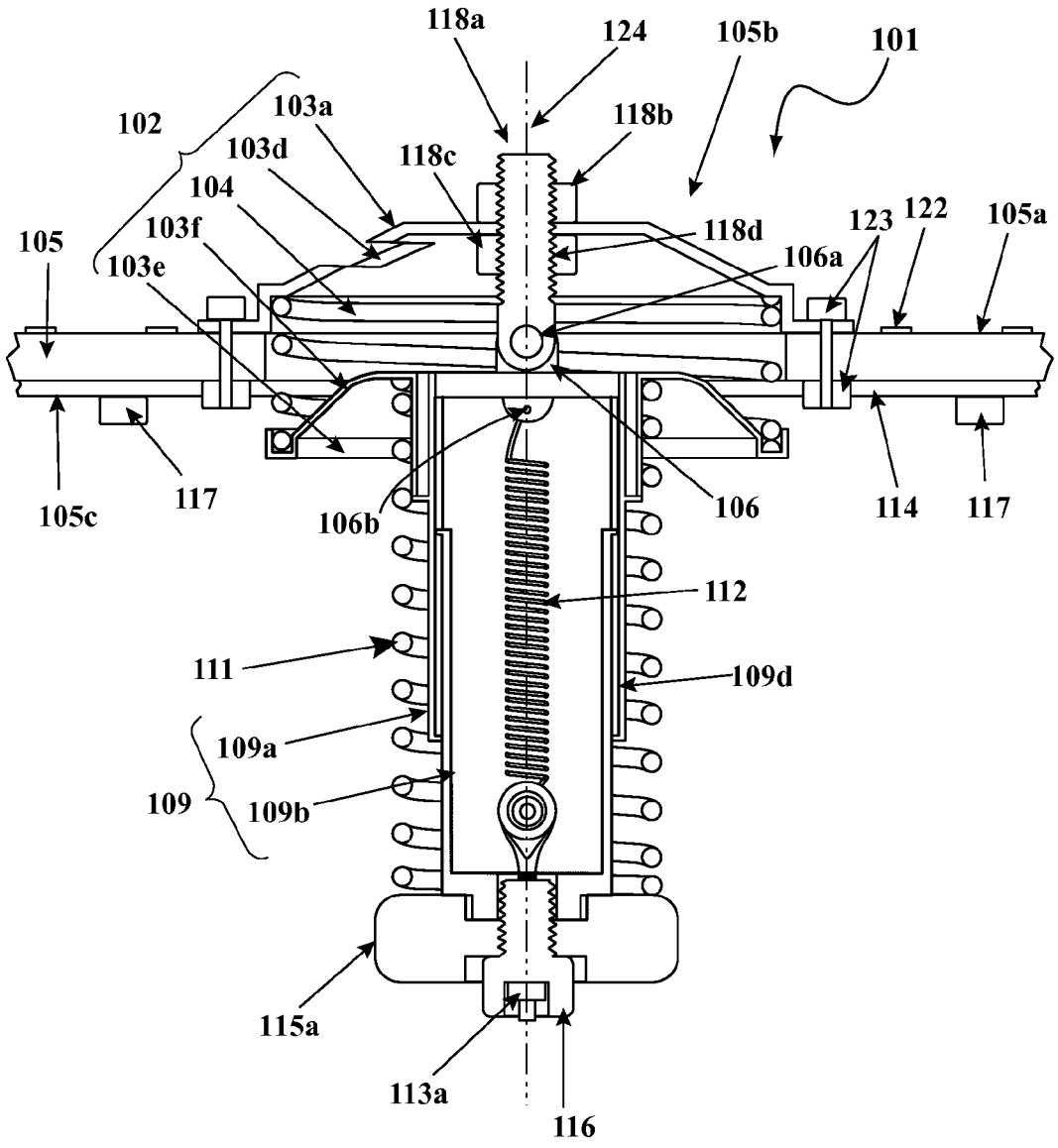
FIG. 6 exemplarily illustrates a partial side sectional view of the skateboard apparatus.

FIG. 6 exemplarily illustrates a partial side sectional view of the skateboard apparatus 100. The collapsible tubular member 109 of the truck assembly 101 of the skateboard apparatus 100 is threadedly connected to the pivot element 106. The tension spring 112 that passes through the collapsible tubular member 109 is attached to an opening 106*b* of the pivot element 106. The tension spring 112 passes axially through the telescoping collapsible tubular member 109 to enforce extended release of the spring energy of the compression spring 111. The connecting element 113 suspended from the tension spring 112 is threaded and passes through the opening 116*a* of the cup screw 116 via the hexagonal counter bore 115*e* of the axle 115*a* of the third truck member 115 exemplarily illustrated in FIG. 1. The tensional force of the tension spring 112 is adjusted, for example, by rotating the nut 113*a* from underneath the third truck member 115. The compression spring 111 is externally and coaxially mounted around the telescoping collapsible tubular member 109.

During operation of the skateboard apparatus 100, the compression spring 111 extends and releases its energy at an uncontrolled rate. To counter this phenomenon, the tension spring 112 of a sufficient force constant is mounted axially through the collapsible tubular member 109 to provide time release of the spring energy, thereby resulting in the time of compression of the compression spring 111 being approximately equal to the time of extension of the compression spring 111. In an embodiment, an upward motion and a downward motion of the collapsible tubular member 109 is guided, for example, by grooves 109*d* configured on the inner surface of the upper sleeve member 109*a* to avoid relative rotational motion of the board structure 105 on a vertical axis 124 that passes through the telescoping collapsible tubular member 109.

The suspension spring 104 of sufficient preconfigured diameter and height is disposed within the housing 103 of the suspension assembly 102 to oscillate in a substantially consistent direction defined by the pivot element 106 along the direction of the length of the board structure 105. The pivot element 106 limits the direction of oscillation of the board structure 105 along the length of the board structure 105. As the angle of orientation of the board structure 105 changes, the suspension spring 104 is alternatively compressed on its one side and relaxed on its other side as disclosed in the detailed description of FIGS. 8A-8D.

The suspension assembly 102 is dimensioned, configured and adapted considering the length of the collapsible tubular member 109 and the length of the board structure 105 for safe operation of the skateboard apparatus 100. The suspension assembly 102 is threadedly connected to the upper sleeve member 109*a* of the collapsible tubular member 109 by the pivot element 106, which is connected to the bolt 118*a* by the pivot pin 107 and thread fitted to the upper sleeve member 109*a*. In an embodiment, axial grooves 118*d* are cut along the length of the bolt 118*a* and tongues 103*c* exemplarily illustrated in FIG. 1 are cut along the circumference of the opening 103*b* in the cap 103*a* of the housing 103 for receiving the grooves 118*d* of the bolt 118*a*. The bolt 118*a* slides vertically along the tongues 103*c* of the opening 103*b* in the cap 103*a*, thereby limiting rotation of the truck assembly 101 about the vertical axis 124 that passes through the collapsible tubular member 109.

Figure 7:
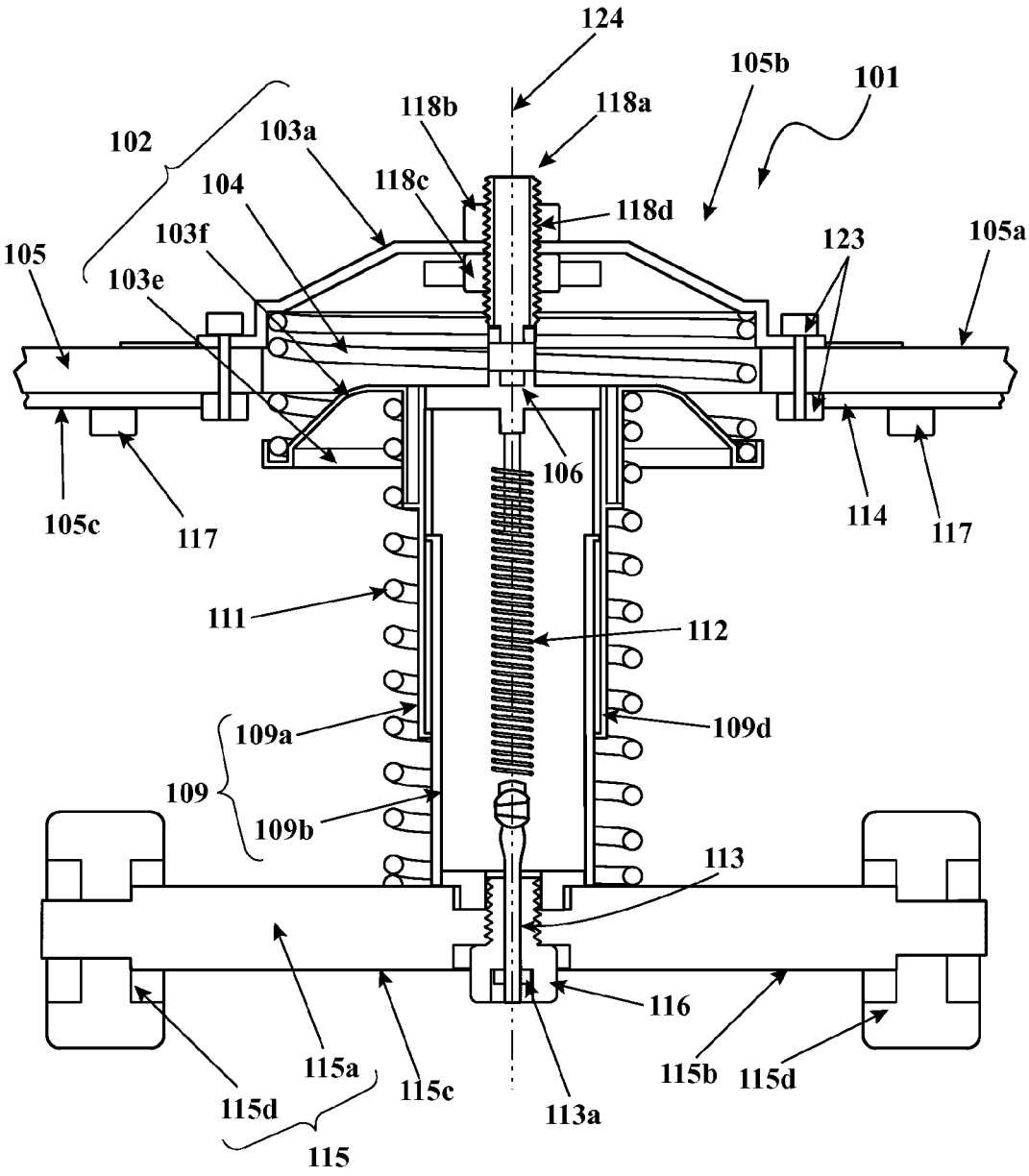
FIG. 7 exemplarily illustrates a partial front sectional view of the skateboard apparatus.

FIG. 7 exemplarily illustrates a partial front sectional side view of the skateboard apparatus 100. The skateboard apparatus 100 disclosed herein is used to simulate a surf-like motion on the ground surface by mounting the telescopic collapsible tubular member 109 through the mid-section 105*b* of the board structure 105, thereby precluding the need for touching a ground surface to gain momentum. As exemplarily illustrated in FIG. 7, the connecting element 113 adjustably affixes the tension spring 112 that coaxially extends through the collapsible tubular member 109, to the third truck member 115.

FIGS. 8A-8D exemplarily illustrate different orientations of the skateboard apparatus 100 when a user propels the skateboard apparatus 100. The skateboard apparatus 100 comprising the truck assembly 101 that comprises the suspension assembly 102, the pivot element 106, the telescopic collapsible tubular member 109, the compression spring 111, and the tension spring 112 is assembled as disclosed in the detailed description of FIGS. 1-2. Consider an example where a user propels the skateboard apparatus 100 by placing herself/himself on the board structure 105 of the skateboard apparatus 100. The board structure 105 propels forward via the two truck members 120 and 115 suspending the second truck member 121 or using the two truck members 115 and 121 suspending the first truck member 120. The suspension spring 104 of the suspension assembly 102 compresses on one side and relaxes on the other side along the longitudinal axis 110 of the board structure 105, thereby creating a rocking motion along the length of the board structure 105. The pivot element 106 pivotally connected to the suspension assembly 102 enables the suspension spring 104 of the suspension assembly 102 to create the rocking motion along the length of the board structure 105 about the longitudinal axis 110 of the board structure 105 exemplarily illustrated in FIG. 1.

The tension spring 112, in communication with the compression spring 111, telescopically extends and retracts the collapsible tubular member 109 for creating an upward motion and a downward motion respectively, of the board structure 105. That is, the collapsible tubular member 109 moves up or down while the suspension assembly 102 allows rocking motion along the longitudinal axis 110 of the board structure 105 by alternating a nose up orientation of the board structure 105 as exemplarily illustrated in FIG. 8A, or a nose down orientation of the board structure 105 as exemplarily illustrated in FIG. 8D. As used herein, the term "nose up" orientation refers to the orientation of the board structure 105 when the third truck member 115 and the second truck member 121 are on the ground surface 125, while the first truck member 120 is lifted up, above the ground surface 125. Also, as used herein, the term "nose down" orientation refers to the orientation of the board structure 105 when the first truck member 120 and the third truck member 115 are on the ground surface 125, while the second truck member 121 is lifted up, above the ground surface 125.

Figure 8A:
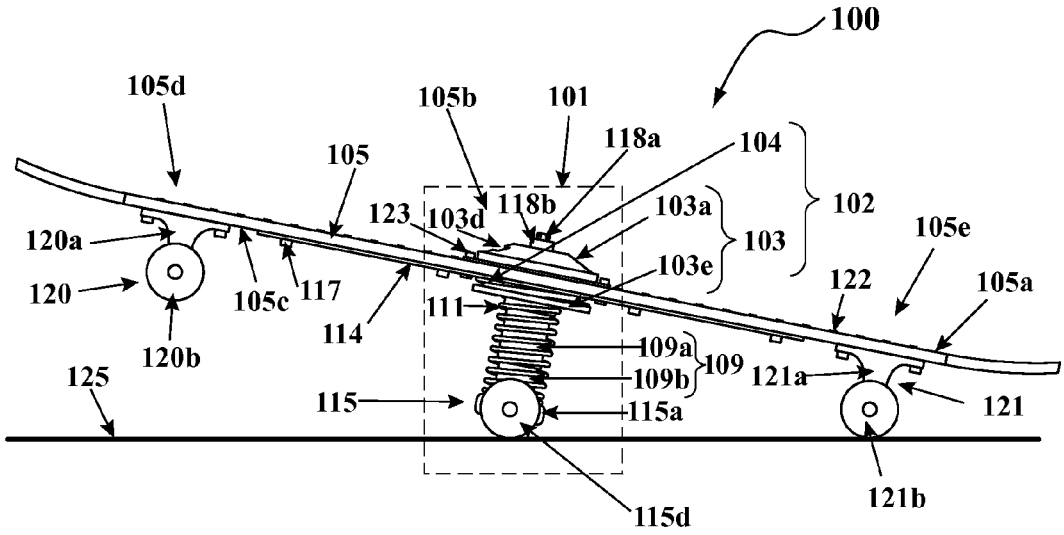
FIGS. 8A-8D exemplarily illustrate different orientations of the skateboard apparatus when a user propels the skateboard apparatus.
Figure 8B:
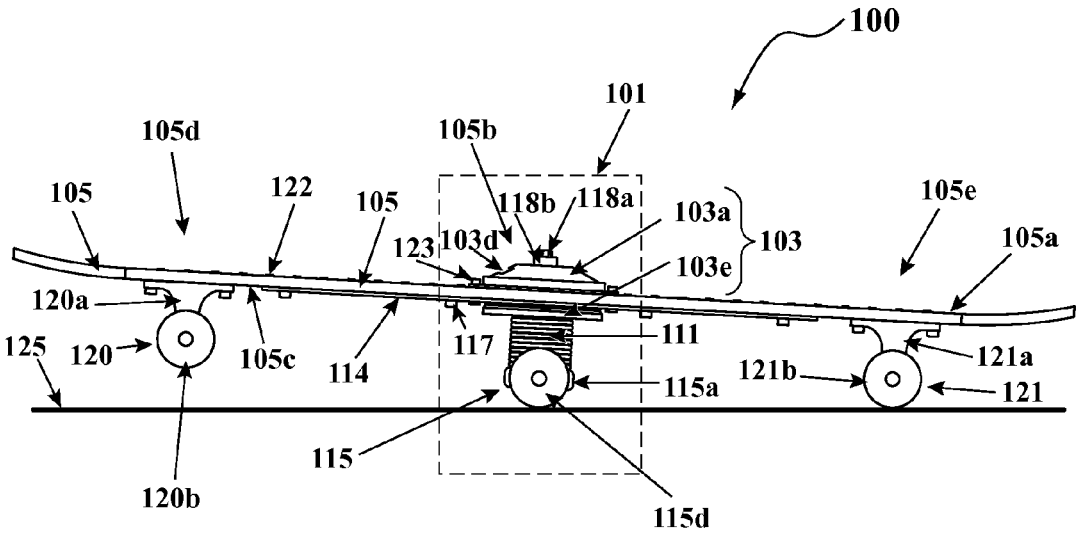
Figure 8C:
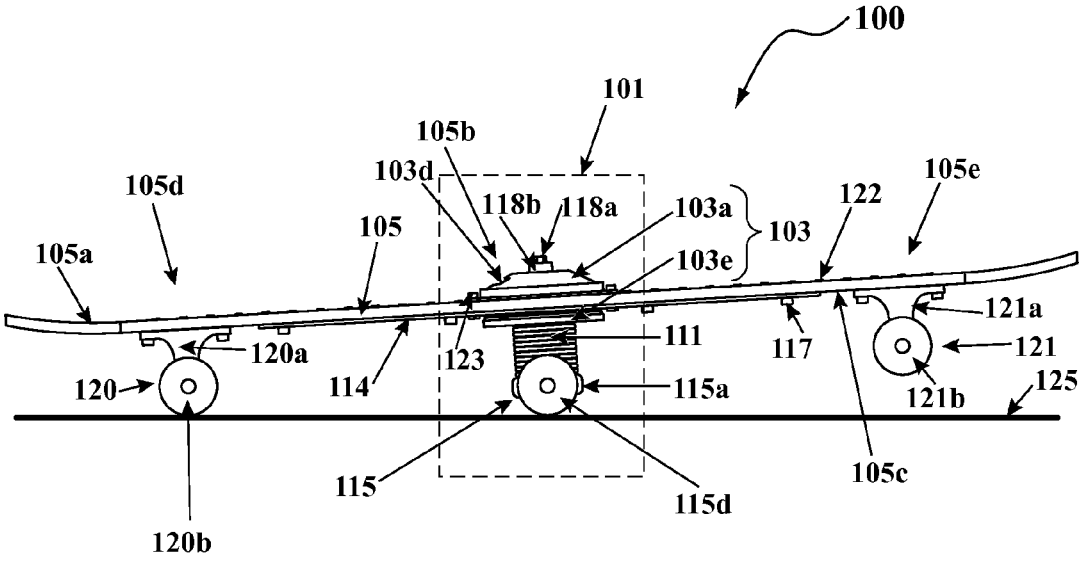
Figure 8D:
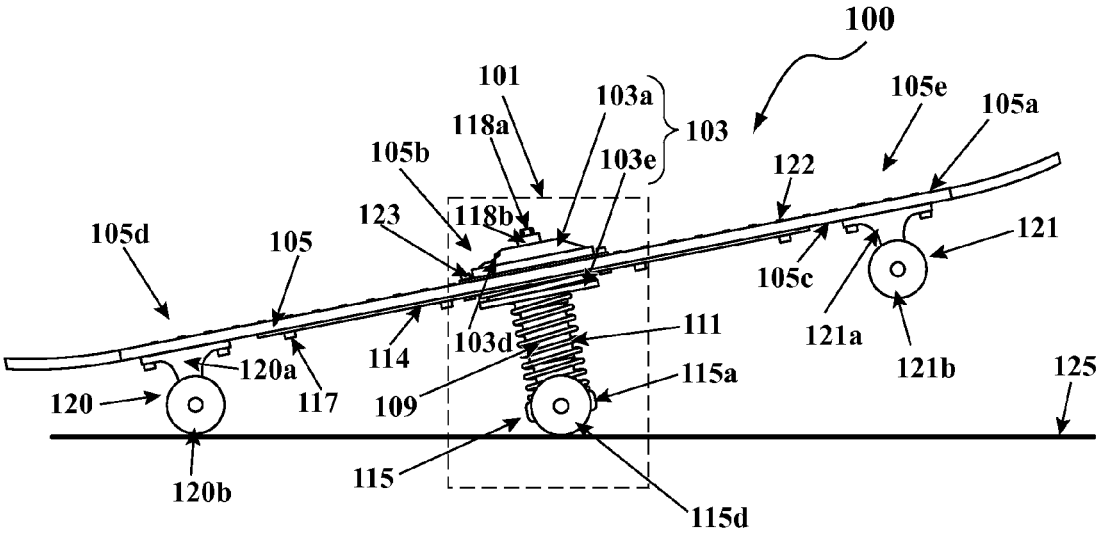

When the board structure 105 is in motion, the center of gravity of the rider-skateboard apparatus 100 moves from the rear section 105*e* to the front section 105*d* of the board structure 105 and the collapsible tubular member 109 descends causing the compression spring 111 to compress and the first truck member 120 to approach the ground surface 125 as exemplarily illustrated in FIG. 8B. When the first truck member 120 approaches the ground surface 125, the user jumps off the skateboard apparatus 100 and the compression spring 111 relaxes causing the collapsible tubular member 109 to ascend as exemplarily illustrated in FIGS. 8C-8D. The compression spring 111 alternately compresses and expands to extend and retract the collapsible tubular member 109, thereby creating an upward motion and downward motion of the board structure 105, while the suspension spring 104 actuates on either side to create the rocking motion. The upward or downward motion caused by the extension and retraction of the collapsible tubular member 109 in addition to the skate-like forward motion of the board structure 105 synchronized with the rocking motion created by the suspension spring 104 creates the surf-like motion.

The pivot element 106 limits the direction of the rocking motion along the length of the board structure 105. The suspension assembly 102 synchronizes the upward motion and the downward motion of the board structure 105 with the rocking motion of the board structure 105 for creating a surf-like motion of the board structure 105 on the ground surface 125. The skateboard apparatus 100 propels forward via the first truck member 120, the second truck member 121, and the third truck member 115, on receiving weight of the user standing on the upper surface 105*a* of the board structure 105, and creates the surf-like motion on the ground surface 125 by the synchronization of the upward motion and the downward motion of the board structure 105 with the rocking motion of the board structure 105. The suspension spring 104 synchronizes the upward and downward motion of the board structure 105 by allowing and creating rocking motion along the longitudinal axis 110 of the board structure 105 and longitudinal to the direction of motion along the longitudinal axis 110. The suspension assembly 102 thereby warrants a smooth and synchronized transition of the nose up orientation and the nose down orientation of the board structure 105.

The suspension assembly 102 reclines the board structure 105 from the nose up orientation to the nose down orientation and the user descends over the board structure 105. The angle between the board structure 105 and the ground surface 125 decreases as the collapsible tubular member 109 collapses due to the weight of the user. When the angle approaches zero, the user jumps to lift his/her weight from the board structure 105, thereby causing the suspension assembly 102 to rock the board structure 105 and changing the orientation of the board structure 105 from nose up to nose down. When the center of mass of the user moves backward, the first truck member 120 goes up as the second truck member 121 goes down as exemplarily illustrated in FIG. 8A. The user therefore moves from one crust to the next crust in a sinusoidal type of motion. By shifting the weight of the user to the center of mass of the board structure 105, the user can tip his/her board structure 105 nose up, nose down, right side down, or left side down. Every time the user jumps on to the board structure 105 he/she finds a slippery slope. The gripping mat 122 on the board structure 105 is designed to provide grip to the user on the board structure 105 until the slope evens out due to the continuously changing center of mass.

The user needs to develop a balancing technique for riding the skateboard apparatus 100. The user stands up on the board structure 105 with knees bent, hanging lose with hands spread to balance front to back and side to side as the center of mass of the board structure 105 continuously changes. By maintaining the nose down orientation of the board structure 105 pulled by gravity, the user gains kinetic energy, the energy of motion, and at the same time loses gravitational potential energy. Further, by turning up the front section 105*d* of the board structure 105, the user trades back kinetic energy for potential energy and rises to the crust of this wave-like motion. The skateboard apparatus 100 disclosed herein improves propulsion by the weight of the user and precludes the need for touching the ground surface 125 repeatedly after every successive stride.

Figure 9:
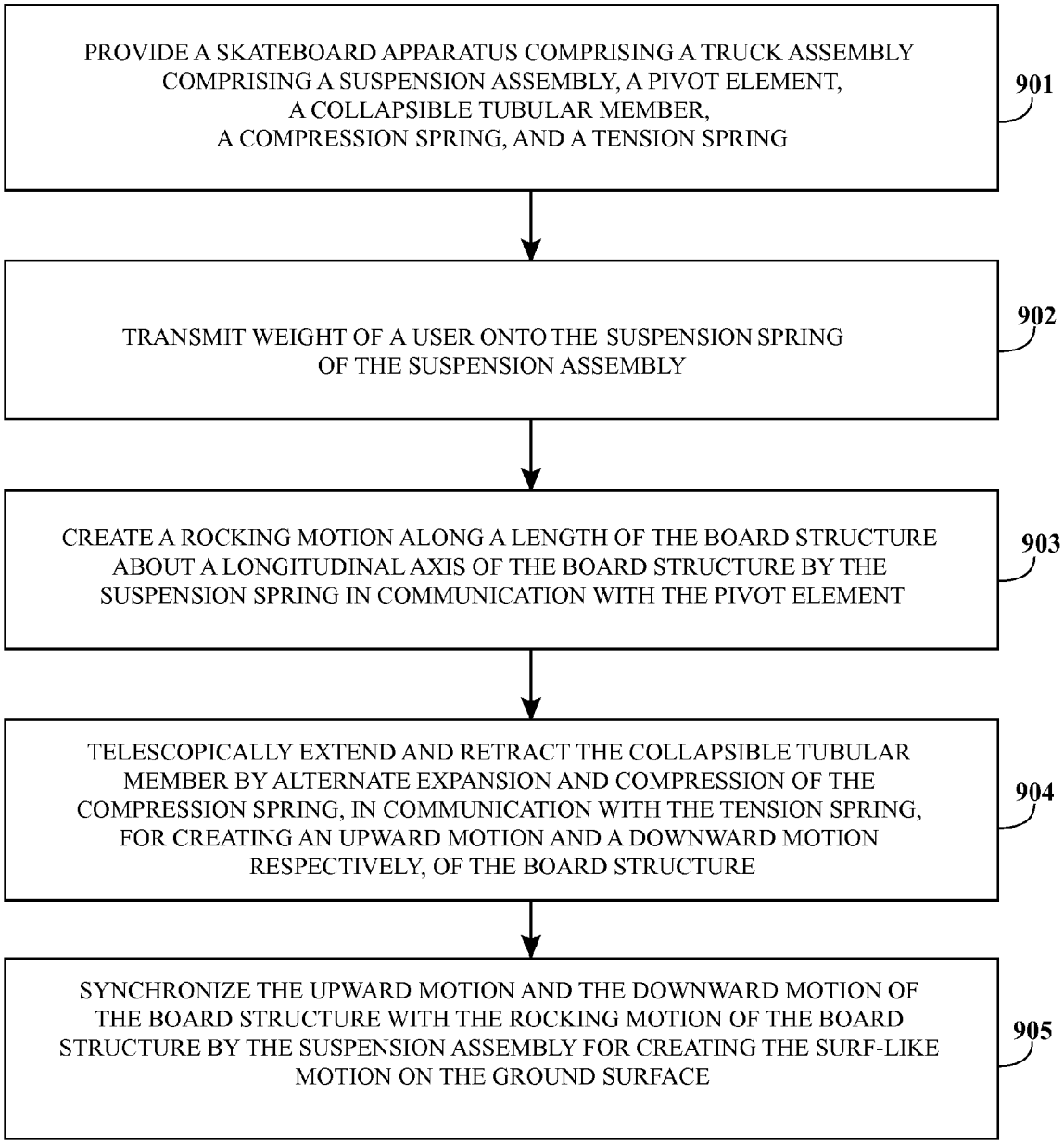
FIG. 9 exemplarily illustrates a method for creating a surf-like motion on a ground surface.

FIG. 9 exemplarily illustrates a method for creating a surf-like motion on a ground surface 125. A skateboard apparatus 100 comprising a truck assembly 101 centrally positioned between a first truck member 120 and a second truck member 121 for supporting a board structure 105, where the truck assembly 101 comprises a suspension assembly 102 comprising a suspension spring 104, a pivot element 106, a collapsible tubular member 109, a compression spring 111, and a tension spring 112 as exemplarily illustrated in FIG. 1, is provided 901. A user transmits 902 his/her weight onto the suspension spring 104 of the suspension assembly 102, during propulsion of the board structure 105 by the user on the ground surface 125 exemplarily illustrated in FIGS. 8A-8D via the first truck member 120, the second truck member 121, and the third truck member 115. The suspension spring 104, in communication with the pivot element 106, creates 903 a rocking motion along the length of the board structure 105 about a longitudinal axis 110 of the board structure 105. The compression spring 111 alternately compresses and expands to telescopically extend and retract the collapsible tubular member 109. The collapsible tubular member 109 telescopically extends and retracts 904 by the alternate expansion and compression of the compression spring 111, in communication with the tension spring 112, for creating an upward motion and downward motion respectively, of the board structure 105. The suspension assembly 102 synchronizes 905 the upward motion and the downward motion of the board structure 105 with the rocking motion of the board structure 105 for creating the surf-like motion on the ground surface 125.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A skateboard apparatus, comprising:

a truck assembly positioned between a first truck member and a second truck member for supporting a board structure, wherein said truck assembly comprises:

a suspension assembly positioned through said board structure, wherein said suspension assembly comprises a suspension spring disposed within a housing that bulges above an upper surface of said board structure, for creating a rocking motion along a length of said board structure;

a pivot element pivotally connected to said suspension assembly for enabling said suspension spring of said suspension assembly to create said rocking motion along said length of said board structure about a longitudinal axis of said board structure;

a collapsible tubular member threadedly connected to said pivot element, wherein said collapsible tubular member is mounted on a third truck member;

a compression spring externally and coaxially mounted around said collapsible tubular member, wherein said compression spring alternately expands and compresses for extending and retracting said collapsible tubular member; and a tension spring coaxially extending through said collapsible tubular member, wherein said tension spring, in communication with said compression spring, telescopically extends and retracts said collapsible tubular member for creating an upward motion and a downward motion respectively, of said board structure;

whereby said skateboard apparatus propels forward via said first truck member, said second truck member, and said third truck member on receiving weight of a user standing on said upper surface of said board structure, and creates a surf-like motion on a ground surface by synchronization of said upward motion and said downward motion of said board structure with said rocking motion of said board structure performed by said suspension assembly.

2. The skateboard apparatus of claim 1, further comprising a gripping mat mounted on said upper surface of said board structure, wherein said gripping mat prevents slippage of said user standing on said upper surface of said board structure.

3. The skateboard apparatus of claim 1, wherein said suspension assembly is configured based on height of said extension of said collapsible tubular member and length of said board structure.

4. The skateboard apparatus of claim 1, further comprising a pre-load fastening assembly comprising a bolt and a nut, wherein said bolt connects said suspension assembly to said pivot element, and wherein a spring rate of said suspension spring of said suspension assembly is adjusted by tightening said nut on said bolt.

5. The skateboard apparatus of claim 1, further comprising a connecting element for adjustably affixing said tension spring to said third truck member, wherein said connecting element statistically loads said compression spring to oppose said tension spring, thereby loading said tension spring to a maximum limit of elasticity to produce a time release force to extend said collapsible tubular member over a period of time.

6. The skateboard apparatus of claim 1, wherein said collapsible tubular member comprises two or more sleeve members coaxially and slidably connected to each other for enabling said extension and said retraction of said collapsible tubular member.

7. The skateboard apparatus of claim 1, wherein each of said first truck member, said second truck member, and said third truck member comprises an axle with wheels for propelling said board structure.

8. The skateboard apparatus of claim 1, wherein said pivot element limits direction of said rocking motion along said length of said board structure.

9. A method for assembling a skateboard apparatus for creating a surf-like motion on a ground surface, comprising:

configuring a truck assembly between a first truck member and a second truck member for supporting a board structure, comprising:

positioning a suspension assembly through said board structure, wherein said suspension assembly comprises a suspension spring disposed within a housing that bulges above an upper surface of said board structure, for creating a rocking motion along a length of said board structure;

pivotally connecting a pivot element to said suspension assembly for enabling said suspension spring of said suspension assembly to create said rocking motion along said length of said board structure about a longitudinal axis of said board structure;

threadedly connecting a collapsible tubular member to said pivot element, wherein said collapsible tubular member is mounted on a third truck member;

externally and coaxially mounting a compression spring around said collapsible tubular member, wherein said compression spring alternately expands and compresses for extending and retracting said collapsible tubular member; and coaxially extending a tension spring through said collapsible tubular member, wherein said tension spring, in communication with said compression spring, telescopically extends and retracts said collapsible tubular member for creating an upward motion and a downward motion respectively, of said board structure;

whereby said skateboard apparatus propels forward via said first truck member, said second truck member, and said third truck member on receiving weight of a user standing on said upper surface of said board structure, and creates said surf-like motion on said ground surface by synchronization of said upward motion and said downward motion of said board structure with said rocking motion of said board structure performed by said suspension assembly.

10. The method of claim 9, further comprising configuring said suspension assembly based on height of said extension of said collapsible tubular member and length of said board structure.

11. The method of claim 9, further comprising mounting a gripping mat on said upper surface of said board structure, wherein said gripping mat prevents slippage of said user standing on said upper surface of said board structure.

12. The method of claim 9, further comprising coaxially and slidably connecting two or more sleeve members of said collapsible tubular member relative to each other for enabling said extension and said retraction of said collapsible tubular member.

13. The method of claim 9, wherein said suspension assembly is pivotally connected to said pivot element via a bolt, wherein a spring rate of said suspension spring of said suspension assembly is adjusted by tightening a nut on said bolt.

14. The method of claim 9, further comprising adjustably affixing said tension spring to said third truck member via a connecting element, wherein said connecting element statistically loads said compression spring to oppose said tension spring, thereby loading said tension spring to a maximum limit of elasticity to produce a time release force to extend said collapsible tubular member over a period of time.

15. A method for creating a surf-like motion on a ground surface, comprising:

providing a skateboard apparatus comprising:

a truck assembly positioned between a first truck member and a second truck member for supporting a board structure, wherein said truck assembly comprises:

a suspension assembly positioned through said board structure, wherein said suspension assembly comprises a suspension spring disposed within a housing that bulges above an upper surface of said board structure;

a pivot element pivotally connected to said suspension assembly;

a collapsible tubular member threadedly connected to said pivot element, wherein said collapsible tubular member is mounted on a third truck member;

a compression spring externally and coaxially mounted around said collapsible tubular member; and a tension spring coaxially extending through said collapsible tubular member;

transmitting weight of a user onto said suspension spring of said suspension assembly, during propulsion of said board structure by said user on said ground surface via said first truck member, said second truck member, and said third truck member;

creating a rocking motion along a length of said board structure about a longitudinal axis of said board structure by said suspension spring of said suspension assembly in communication with said pivot element;

telescopically extending and retracting said collapsible tubular member by alternate expansion and compression of said compression spring, in communication with said tension spring, for creating an upward motion and a downward motion respectively, of said board structure; and synchronizing said upward motion and said downward motion of said board structure with said rocking motion of said board structure by said suspension assembly for creating said surf-like motion on said ground surface.

16. The method of claim 15, wherein said collapsible tubular member comprises two or more sleeve members coaxially and slidably connected to each other for enabling said extension and said retraction of said collapsible tubular member.

17. The method of claim 15, further comprising limiting direction of said rocking motion along said length of said board structure by said pivot element.

18. The method of claim 15, wherein said skateboard apparatus further comprises a pre-load fastening assembly comprising a bolt and a nut, wherein said bolt connects said suspension assembly to said pivot element, and wherein a spring rate of said suspension spring of said suspension assembly is adjusted by tightening said nut on said bolt.

19. The method of claim 15, wherein said skateboard apparatus further comprises a connecting element for adjustably affixing said tension spring to said third truck member, wherein said connecting element statistically loads said compression spring to oppose said tension spring, thereby loading said tension spring to a maximum limit of elasticity to produce a time release force to extend said collapsible tubular member over a period of time.

20. The method of claim 15, wherein said suspension assembly is configured based on height of said extension of said collapsible tubular member and length of said board structure.

* * * * *